United States Patent [19]

Swartwout

[11] 4,416,381

[45] Nov. 22, 1983

[54] BOTTLE CAP WITH INTEGRAL MEASURING CUP AND BOTTLE CLOSURE

[76] Inventor: Everett W. Swartwout, 5816A S. Wolf Rd., Western Springs, Ill. 60558

[21] Appl. No.: 325,295

[22] Filed: Nov. 27, 1981

[51] Int. Cl.[3] ..... B65D 41/26

[52] U.S. Cl. ..... 215/228; 73/427; 215/DIG. 7

[58] Field of Search ..... 215/228, DIG. 7; 23/426, 427, 428

[56] References Cited

FOREIGN PATENT DOCUMENTS 2042403 3/1972 Fed. Rep. of Germany ..... 215/228

560632 4/1975 Switzerland ..... 215/DIG. 7

364528 12/1931 United Kingdom ..... 215/DIG. 7

*Primary Examiner*—Donald F. Norton

*Attorney, Agent, or Firm*—Cesari and McKenna

[57] ABSTRACT

A bottle cap forming an integral measuring cup and bottle closure, including a cup having a base and sidewall, and a closure member extending from the base. The cup sidewalls are graduated to indicate volume levels. The closure member may extend upwardly, interiorly of the cup, may be solid or hollow, and may taper upwardly to facilitate insertion into the mouth of the bottle. Alternately, the hollow closure may be provided with threads for use with a bottle requiring a threaded closure. The closure member may also extend downwardly, and the cup may be provided with a skirt.

10 Claims, 6 Drawing Figures

BOTTLE CAP WITH INTEGRAL MEASURING CUP AND BOTTLE CLOSURE

BACKGROUND OF THE INVENTION

1. Field of the Invention

The invention relates generally to closures and more particularly to closures for use with containers for liquids, and having integral means for measuring amounts of liquids to be dispensed therefrom.

2. Description of the Prior Art

When dispensing many types of liquids from bottles, one often prefers to measure out certain amounts of the liquids and then to cap the bottle to avoid contamination, evaporation, or spillage of the contents. This is the case, for example, with liquid medicines, liquors, liquids such as cleaning fluids to be diluted according to the manufacturer's directions, and so forth.

When measuring different types of liquids, it is often desirable or even necessary to wash the measuring glass before dispensing a second liquid to avoid contaminating it with the residue from a prior liquid that may have been measured in the glass before. It may be dangerous, for example, to dispense different medicines in the same glass without washing the glass between medicines. Also, it is known that mixing certain chemicals, such as certain cleaning fluids, which may occur if a measuring glass contains residue from a previous fluid, can be dangerous. In addition, measuring out liquor for a mixed drink in a glass that had been used for other liquors can lead to undesirable flavors in the mixed drink.

Since measuring cups are not normally attached to particular bottles, one often has to look for one, which can be very time consuming. After the cup is located, it may be necessary to wash the cup prior to using it which can further delay dispensing liquid from the bottle. Also, if no measuring cup is located, it may be necessary to estimate the amount dispensed, which is also undesirable.

U.S. Pat. No. 1,419,580 to Molinari discloses one solution to these problems, a combination bottle stopper and measuring glass comprising an elongated tubular member closed off capped at one end and open at the other end. The open end is tapered to fit into the opening of a bottle. Along the sidewalls of the tubular portion are graduations denoting various fluid ounce levels. However, Molinari's stopper has several drawbacks. It is vulnerable to being broken due to its height above the bottle which makes it more easily stuck during careless handling. Furthermore, it makes the bottle more susceptible to being tipped over because of the length that it protrudes from the bottle. The Molinari stopper is inconvenient to use in measuring because the open end, which constitutes the stopper, tapers to an opening which has a smaller diameter than the mouth of the bottle which makes pouring fluids into the stopper difficult.

SUMMARY

This invention avoids these problems by providing an integral bottle cap and measuring cup that sits compactly about the mouth of the bottle. Briefly, the invention provides a measuring cup which has sidewalls and a base, and a stopper extending from the base into the interior of the cup. The stopper fits into a bottle opening, and the sidewalls of the cup sit around the bottle top. The cap, after being removed from the bottle and inverted, can be used to measure liquid from the associated bottle, and to close the bottle after it has been used, to prevent contamination of the contents of the bottle, and prevent its being used to measure other liquids. In another embodiment, the stopper is hollow and the sidewall of the stopper is threaded. The threaded stopper can be used to seal a bottle requiring a threaded closure.

DESCRIPTION OF AN ILLUSTRATIVE EMBODIMENT

Figure 1:
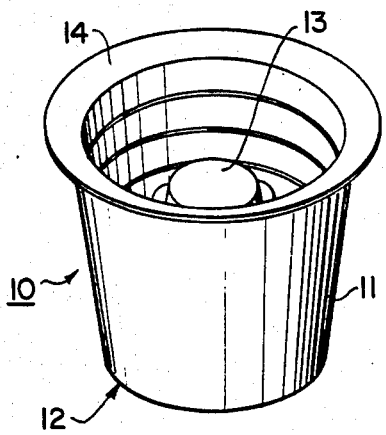
FIG. 1 is a perspective view of an integral bottle cap and measuring cup according to the invention.
Figure 2:
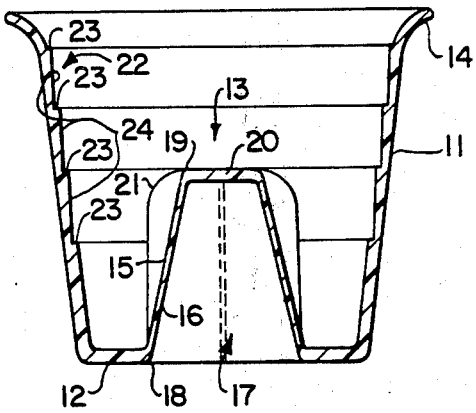
FIG. 2 is a side elevational view of the cap shown in FIG. 1, partially in section, showing a first closure arrangement.

An exemplified in FIGS. 1 and 2, an integral bottle cap and measuring cup 10 according to the invention includes a sidewall 11 and a base 12 forming a cup, and a hollow stopper 13 extending upwardly into the cup. The sidewall flares outwardly slightly, shaped like the frustum of a cone with the apex pointing downwardly (as shown in FIG. 1). The upper edge of the sidewall 11 terminates in an outwardly-flaring lip or rim 14.

Stopper 13 includes sidewall 15 which tapers outwardly also shaped like the frustum of a cone but with its apex pointed upwardly as shown in FIGS. 1 and 2. Sidewall 15 has a lower edge 16 attached to base 12. Base 12 has a central aperture 17 defined by a periphery 18, with the lower edge 16 being attached to the base at periphery 18.

Sidewall 15 also has an upper edge 19. A circular top 20 is affixed to the upper edge 19 to close off the stopper. Six wings 21 extend radially outwardly from sidewall 15 spaced apart around stopper 13.

The inner surface 22 of sidewall 11 is provided with a series of horizontal steps 23 formed at different levels. Between steps 23 are substantially vertical sidewall sections 24. The steps identify the different fluid ounce graduation levels. For example, the steps 23 may be formed at one-half ounce intervals or one ounce intervals, or at other selected graduations. Also the top of stopper 13 may correspond to the height of one of the graduations, for example, the one ounce level or some other desired amount.

Figure 3:
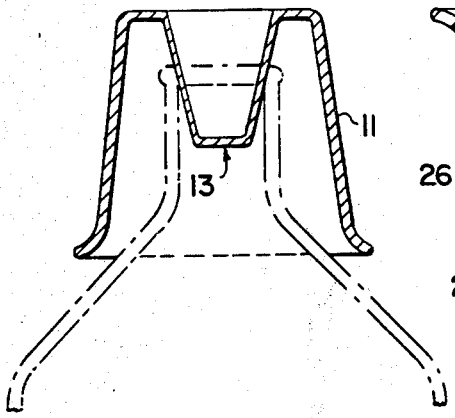
FIG. 3 is a side elevational view showing the cap in use on a bottle.

FIG. 3 illustrates cap 10 inserted into the neck or opening of a bottle. A portion of a respresentative bottle is shown in phantom lines in FIG. 3. The stopper 13 fits into the neck opening and the sidewall 11 sits compactly around the stopper and bottleneck.

Sidewall 11 preferably flares upwardly and the stopper 13 preferably tapers upwardly, as shown in FIGS. 1 and 2. Providing the stopper with the taper facilitates insertion of the stopper into a bottle opening. Providing the sidewall with the outward flare facilitates pouring the liquid into the measuring cup and provides for a more uniform flow of the liquid when pouring it out of the cup; the liquid will not flow down the outside of the sidewall, which may occur if the sidewall 11 was not flared. The stopper sidewall 15 is fairly rigid, yielding just enough to permit the stopper to be frictionally retained in the bottle opening. The wings deform slightly while being inserted into the bottle to assist in retaining the stopper in the bottle. Wings 21 preferably taper toward the stopper near the top to facilitate the easy insertion of stopper 13 into the bottle. The sidewall 11 and base 12 of cup 10 are preferably rigid. Annular ribs may be provided instead of wings 21; however, the ribs may result in sidewall 15 being too stiff, which can make it difficult to insert the stopper into the bottle.

The outward sloping of sidewall 11, the opposite sloping of stopper 13, and the hollow interior of the stopper, combine to permit the caps 10 to be stacked in a closely nested relationship for storage or shipment.

Figure 4:
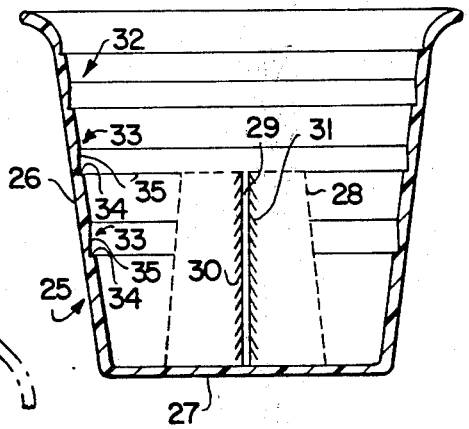
FIG. 4 is a side elevational view, partially in section, of a second embodiment of the invention, showing a second closure arrangement.

FIG. 4 illustrates a second embodiment of the invention in which a solid stopper is provided instead of the hollow stopper 13 shown in FIGS. 1 and 2. This embodiment includes a cap 25 having a sidewall 26, a circular base 27 and a solid stopper 28 extending upwardly from base 27. The arrangement for attaching the stopper to the base includes a stud 29 that extends upwardly from base 27, and has a plurality of barbs 30 extending outwardly and downwardly therefrom. The stud is inserted axially through the stopper (a hole 30 may be provided in the stopper for this) until the stopper rests against the base. The barbs 30 extend into stopper 28, preventing it from being withdrawn from the stud. An adhesive may be provided along the stud and at the base to enhance retention of the stopper by the stud and insure that it is not inadvertently pulled off the stud. The solid stopper of cap 25 will prevent the caps 25 of FIG. 4 from being stacked as closely as the cups 10 of FIG. 2. Caps 25 can be nested only until the top of stopper 28 abuts circular base 27 of the adjoining cup. Stopper 28 may be a conventional stopper of cork, rubber or other resilient material.

FIG. 4 also shows another arrangement for identifying the different levels or graduations. In the arrangement shown in FIG. 4, the inner surface 32 of the sidewall 26 is generally parallel to the outer surface. The graduations are marked by notches 33 in the sidewall, each having an outwardly extending horizontal step 34 and a short vertical portion 35.

Other arrangements may be provided to identify various graduations; for example, annular ribs may be provided.

Also, stoppers 13 or 24 can be provided extending above or below the one ounce level in the cup. The one ounce level has been chosen as a specific example because it is a standard measurement. Indeed, the height of the stopper need not have any relationship to any fluid measurement in the cup.

A specific example of a cap may have the following internal dimensions: the internal diameter of the cup at the base is one and one half inches; the internal diameter at the top of the cup is one and sixty-three/sixty-fourths inches at the bottom. The stopper is one and one-sixteenth inch in height, seven-eighths inch in diameter at the bottom and seven-sixteenths of an inch at the top. The graduations are as follows: five-eighths inch from the base for the one-half ounce level, one and one-sixteenth inches from the base for the one ounce level, one and twenty-seven/sixty-fourths inches from the base for the one and one-half ounce level, and one and fourty-six/sixty-fourths inches from the base for the two ounce level.

Figure 5:
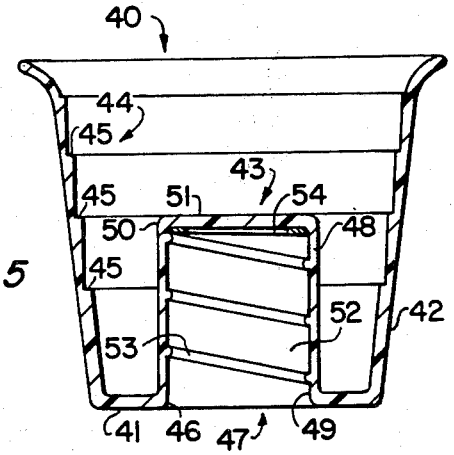
FIG. 5 is a side elevational view, partially in section, of a third embodiment of the invention, showing a closure arrangement for use as a threaded closure.

FIG. 5 exemplifies a third embodiment of the invention, in which the stopper is provided with threads for use with a bottle requiring a threaded closure. This embodiment includes a cap 40 having a base 41, a sidewall 42 and a threaded closure 43. The inner surface 44 of sidewall 42 includes graduation-defining notches 45. Base 41 has a rim 46 defining an aperture 47.

Closure 43 includes a cylindrical sidewall 48 having a lower edge 49 attached to rim 46, and an upper edge 50. A circular top 51 is attached to edge 50 to close off closure 43.

The inner surface 52 of sidewall 48 is provided with a thread 53 to mate with a thread on a bottle (not shown). Thread 53 may be a helical rib protruding from surface 52 as shown in FIG. 5, or may alternatively be a helical groove formed in the sidewall 48. A conventional compressible pad 54 may be provided lining the underside of top 51 to form a seal between top 51 and the bottle opening.

Since the closure 43 of cap 40 is not tapered, cap 40 will not nest as closely in a stack as will cap 10. Cap 40 will nest until the top 51 of closure 43 abuts the base 41 of the next adjoining cup.

Figure 6:
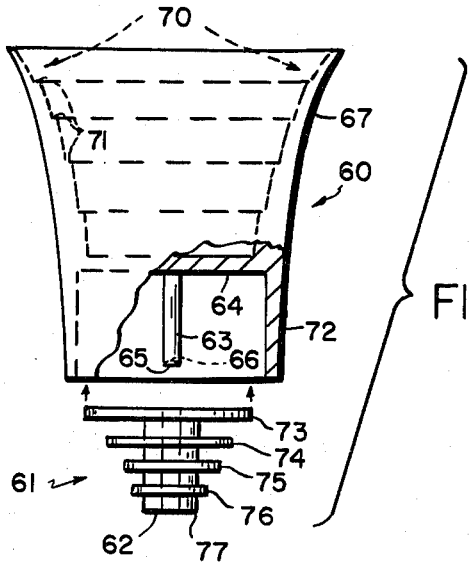
FIG. 6 is a side elevational view, partially in section, of a fourth embodiment of the invention, showing a modification of the embodiment of FIG. 5.

FIG. 6 illustrates in exploded form a fourth embodiment of the invention. This embodiment includes a measuring cup portion, shown generally at 60, and a closure portion, indicated generally at 61. The closure portion 61 includes a bore 62 that, when closure portion 71 is assembled onto cup portion 61, is situated on a stud 63 projecting downwardly from the base 64 of cup portion 60. The free end of stud 63 is provided with a recess 65 defining a rim 66.

Measuring cup 60, as with the cup portions of the other embodiments disclosed herein, includes a sidewall 67 having an inner surface 70 with graduation-defining notches 71. The cup 60 also includes a skirt 72 depending downwardly from the lower rim of base 64 to surround stud 63, and closure portion 61 when assembled to cup 60. The skirt 72 allows the cup 60 to stand upright when it is placed on a table or counter, without the cup having to be inverted. If skirt 72 is not provided, for the embodiment of FIG. 6, the depending closure portion 61 would not provide a stable support if the cap is removed from the bottle and put on a table.

Closure portion 61 is also provided with a series of flexible disks 73–76 projecting horizontally (as shown in FIG. 6) from a central core member 77 that also serves to define bore 62. The upper disk 73 in one specific embodiment is much thicker than the others, and, when closure portion 61 is assembled to cup portion 60, abuts the lower surface of base 64. The upper disk may be of sufficient diameter to abut the rim of the bottle mouth when in place to seal the bottle. The remaining disks 74–76, or wings, are of sufficient diameter and flexibility to frictionally hold the closure member in the mouth of a bottle when the cap is in place.

In one specific embodiment, cup portion 60 and closure portion 61 are fabricated separately to facilitate the use of different materials therefor. In one embodiment, cup portion 60 is molded of transparent plastic such as polystyrene or acrylic, and the stopper portion is molded of polyethylene with standard additives to enhance flexibility. The stopper portion is attached to cup 60, specifically to stud 63, in a three-step process in which the stopper portion is heated to expand the bore 62, the core member 77 is slipped over stud 63, and the stopper portion is cooled. This final cooling allows the core member 77 to shrink tightly about stud 63. If further security is needed to hold stopper portion 61, the rim 66 of recess 65 may be flared outwardly by a hot iron or ultrasonic welding.

Caps 11 and 40 may be molded in one piece by conventional molding techniques. In cup 25, the base 27, sidewall 26 and stud 29 may be molded in one piece, and then stopper 28 can be slipped over the stud to complete the cup.

In caps 10 and 25, the sidewalls depend downwardly around the mouth of the bottle and can prevent dust and dirt from accumulating on the mouth of the bottle. The threaded stopper of cap 40 and skirt of cup 60 will also prevent such accumulation.

The outer surface of sidewalls 11, 26, 42 and 67 have been left relatively unmarked to permit advertising or the like to be put thereon.

It will thus be seen from the foregoing that the objects made apparent from the preceding description are efficiently attained. However, since certain changes may be made in the above construction without departing from the scope of the invention as defined by the appended claims, it is intended that the embodiments described above and shown in the accompanying drawing be interpreted as illustrative only, and not in a limiting sense.

What is claimed as new and desired to be secured by Letters Patent of the United States is:

1. A bottle cap including an integral measuring cup comprising a base having a periphery, a sidewall extending upwardly from said periphery forming a cup having at least one graduation on the interior wall of said cup indicating a volume level, and a closure member extending from the base and adapted to seal the opening of a bottle, said closure member including a plurality of spaced apart disk-shaped wing members extending parallel with said base, said wing members being adapted to deform when said closure member is inserted into a bottle to hold the cap on the bottle and prevent spillage therefrom.

2. A cap as recited in claim 1 in which the graduation comprises an annular notch formed in the sidewall of the cup.

3. A cap as recited in claim 1 in which said closure member extends downwardly from said base, said cup further comprising a skirt extending downwardly to surround said closure member, said closure member and said skirt being spaced apart to accommodate the neck of the bottle.

4. A cap as recited in claim 3 in which said closure member comprises a core member and said wings comprise a plurality of flexible disks extending from said core member, said disks being parallel to said base.

5. A cap as recited in claim 4 in which said base includes a downwardly-projecting stud and said core member includes a bore of sufficient diameter to facilitate the core member being frictionally retained by said stud.

6. A cap as recited in claim 5 in which the free end of said stud includes a recess having a rim, the rim being deformable to permit its being flared to further retain said closure member on said stud.

7. A cap as recited in claim 5 formed by heating the core member to enlarge the bore, slipping the core member over said stud and cooling core member to shrink the bore, the core member then being frictionally retained by said stud.

8. A bottle cap including an integral measuring cup comprising a base having a periphery, a sidewall extending upwardly from said periphery forming a cup having at least one graduation on the interior wall of said cup indicating a volume level, and a closure member extending from the base and adapted to seal the opening of a bottle, said closure member including a support member coaxial with said cup and a plurality of relatively thin wing members circumferentially spaced apart and attached to the side of and extending radially from said support member and extending longitudinally along said support member coaxial with said cup, said wing members being adapted to deform when said closure member is inserted into a bottle to hold the cap on the bottle.

9. A cap as recited in claim 8 in which said closure member extends interiorly of said cup.

10. A cap as recited in claim 8 in which said support member comprises a resilient frusto-conical member having a base attached to the base of the measuring cup.

* * * * *